US010156107B2

(12) United States Patent
Krueger, V

(10) Patent No.: US 10,156,107 B2
(45) **Date of Patent: *Dec. 18, 2018**

(54) ECCENTRIC LINKAGE GRIPPER

(71) Applicant: WWT North America Holdings, Inc., Houston, TX (US)

(72) Inventor: Rudolph Ernst Krueger, V, Aliso Viejo, CA (US)

(73) Assignee: WWT North America Holdings, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/291,925

(22) Filed: Oct. 12, 2016

(65) Prior Publication Data

US 2017/0247963 A1 Aug. 31, 2017

Related U.S. Application Data

(63) Continuation of application No. 14/222,310, filed on Mar. 21, 2014, now Pat. No. 9,488,020.

(60) Provisional application No. 61/954,372, filed on Mar. 17, 2014, provisional application No. 61/932,192, filed on Jan. 27, 2014, provisional application No. 61/933,755, filed on Jan. 30, 2014.

(51) Int. Cl.

| | |
|---|---|
| ***E21B 23/00*** | (2006.01) |
| ***E21B 23/01*** | (2006.01) |
| ***E21B 23/04*** | (2006.01) |
| ***E21B 4/18*** | (2006.01) |

(52) U.S. Cl.

CPC ..... *E21B 23/01* (2013.01); *E21B 4/18* (2013.01); *E21B 23/00* (2013.01); *E21B 23/04* (2013.01)

(58) Field of Classification Search

CPC ..... E21B 23/01; E21B 23/04
USPC ..... 166/381
See application file for complete search history.

(56) References Cited

U.S. PATENT DOCUMENTS

| | | | |
|---|---|---|---|
| 2,141,030 | A | 12/1938 | Clark |
| 2,167,194 | A | 7/1939 | Anderson |
| 2,271,005 | A | 1/1942 | Grebe |
| 2,569,457 | A | 10/1951 | Dale et al. |
| 2,727,722 | A | 12/1955 | Conboy |
| 2,783,028 | A | 2/1957 | Jamison |

(Continued)

FOREIGN PATENT DOCUMENTS

| | | |
|---|---|---|
| AU | 2002 230623 | 3/2007 |
| AU | 2004-4210989 | 3/2009 |

(Continued)

OTHER PUBLICATIONS

PCT International Search Report and Written Opinion for PCT Application No. PCT/US2015/010889, dated May 27, 2015.

(Continued)

*Primary Examiner* — Taras P Bemko
(74) *Attorney, Agent, or Firm* — Knobbe Martens Olson & Bear LLP

(57) ABSTRACT

A gripper mechanism for a downhole tool is disclosed that includes an eccentric linkage mechanism. In operation, an axial force generated by a power section of the gripper expands the linkage mechanism, which applies a radial force to the interior surface of a wellbore or passage. A sliding portion allows the gripper to slide along a surface of the formation in response to the radial force applied to the interior surface of the wellbore or passage.

13 Claims, 10 Drawing Sheets

(56) References Cited

U.S. PATENT DOCUMENTS 2,946,565 A 7/1960 Williams
2,946,578 A 7/1960 De Smaele
3,138,214 A 6/1964 Bridwell
3,180,436 A 4/1965 Kellner et al.
3,180,437 A 4/1965 Kellner et al.
3,185,225 A 5/1965 Ginies
3,224,513 A 12/1965 Weeden, Jr.
3,224,734 A 12/1965 Hill
3,225,843 A 12/1965 Ortloff et al.
3,376,942 A 4/1968 Van Winkle
3,497,019 A 2/1970 Ortloff
3,599,712 A 8/1971 Magill
3,606,924 A 9/1971 Malone
3,661,205 A 5/1972 Belorgey
3,664,416 A 5/1972 Nicolas et al.
3,797,589 A 3/1974 Kellner et al.
3,827,512 A 8/1974 Edmond
RE28,449 E 6/1975 Edmond
3,941,190 A 3/1976 Conover
3,978,930 A 9/1976 Schroeder
3,992,565 A 11/1976 Gatfield
4,040,494 A 8/1977 Kellner
4,085,808 A 4/1978 Kling
4,095,655 A 6/1978 Still
4,141,414 A 2/1979 Johansson
4,184,546 A 1/1980 Nicolas et al.
4,274,758 A 6/1981 Schosek
4,314,615 A 2/1982 Sodder, Jr. et al.
4,365,676 A 12/1982 Boyadjieff et al.
4,372,161 A 2/1983 de Buda et al.
4,385,021 A 5/1983 Neeley
4,440,239 A 4/1984 Evans
4,463,814 A 8/1984 Horstmeyer et al.
4,558,751 A 12/1985 Huffaker
4,573,537 A 3/1986 Hirasuna et al.
4,588,951 A * 5/1986 Ohmer ..... E21B 17/1021 250/268
4,600,974 A 7/1986 Lew et al.
4,615,401 A 10/1986 Garrett
4,674,914 A 6/1987 Wayman et al.
4,686,653 A 8/1987 Staron et al.
4,811,785 A 3/1989 Weber
4,821,817 A 4/1989 Cendre et al.
4,854,397 A 8/1989 Warren et al.
4,926,937 A 5/1990 Hademenos
4,951,760 A 8/1990 Cendre et al.
5,010,965 A 4/1991 Schmelzer
5,052,211 A 10/1991 Cohrs et al.
5,090,259 A 2/1992 Shishido et al.
5,169,264 A 12/1992 Kimura
5,184,676 A 2/1993 Graham et al.
5,186,264 A 2/1993 du Chaffaut
5,203,646 A 4/1993 Landsberger et al.
5,310,012 A 5/1994 Cendre et al.
5,316,094 A 5/1994 Pringle et al.
5,358,039 A 10/1994 Fordham
5,358,040 A 10/1994 Kinley et al.
5,363,929 A 11/1994 Williams et al.
5,394,951 A 3/1995 Pringle et al.
5,419,405 A 5/1995 Patton
5,425,429 A 6/1995 Thompson
5,449,047 A 9/1995 Schivley, Jr.
5,467,832 A 11/1995 Orban et al.
5,494,111 A 2/1996 Davis
5,519,668 A 5/1996 Montaron
5,542,253 A 8/1996 Ganzel
5,613,568 A 3/1997 Sterner et al.
5,622,231 A 4/1997 Thompson
5,752,572 A 5/1998 Baiden et al.
5,758,731 A 6/1998 Zollinger
5,758,732 A 6/1998 Liw
5,765,640 A 6/1998 Milne et al.
5,794,703 A 8/1998 Newman et al.
5,803,193 A 9/1998 Krueger et al.
5,845,796 A 12/1998 Miller
5,857,731 A 1/1999 Heim et al.
5,947,213 A 9/1999 Angle et al.
5,954,131 A 9/1999 Salwasser
5,960,895 A 10/1999 Chevallier et al.
5,979,550 A 11/1999 Tessier
5,996,979 A 12/1999 Hrsuch
6,003,606 A 12/1999 Moore et al.
6,026,911 A 2/2000 Angle et al.
6,031,371 A 2/2000 Smart
6,082,461 A 7/2000 Newman
6,089,323 A 7/2000 Newman et al.
6,112,809 A 9/2000 Angle
6,216,779 B1 4/2001 Reinhardt
6,230,813 B1 5/2001 Moore et al.
6,232,773 B1 5/2001 Jacobs et al.
6,241,031 B1 6/2001 Beaufort et al.
6,273,189 B1 8/2001 Gissler et al.
6,286,592 B1 9/2001 Moore et al.
6,315,043 B1 11/2001 Farrant et al.
6,345,669 B1 2/2002 Buyers et al.
6,347,674 B1 2/2002 Bloom et al.
6,378,627 B1 4/2002 Tubel et al.
6,427,786 B2 8/2002 Beaufort et al.
6,431,270 B1 8/2002 Angle
6,431,291 B1 8/2002 Moore et al.
6,464,003 B2 10/2002 Bloom et al.
6,478,097 B2 11/2002 Bloom et al.
6,601,652 B1 8/2003 Moore et al.
6,609,579 B2 8/2003 Krueger et al.
6,629,568 B2 10/2003 Post et al.
6,640,894 B2 11/2003 Bloom et al.
6,651,747 B2 11/2003 Chen et al.
6,679,341 B2 1/2004 Bloom et al.
6,702,010 B2 3/2004 Yuratich et al.
6,712,134 B2 3/2004 Stoesz
6,715,559 B2 4/2004 Bloom et al.
6,722,442 B2 4/2004 Simpson
6,745,854 B2 6/2004 Bloom et al.
6,758,279 B2 7/2004 Moore et al.
6,796,380 B2 9/2004 Xu
6,827,149 B2 12/2004 Hache
6,868,906 B1 3/2005 Vail, III et al.
6,910,533 B2 6/2005 Guerrero
6,920,936 B2 7/2005 Sheiretov et al.
6,935,423 B2 8/2005 Kusmer
6,938,708 B2 9/2005 Bloom et al.
6,953,086 B2 10/2005 Simpson
7,048,047 B2 5/2006 Bloom et al.
7,059,417 B2 6/2006 Moore et al.
7,080,700 B2 7/2006 Bloom et al.
7,080,701 B2 7/2006 Bloom et al.
7,090,007 B2 8/2006 Stuart-Bruges et al.
7,121,364 B2 10/2006 Mock et al.
7,143,843 B2 12/2006 Doering et al.
7,156,181 B2 1/2007 Moore et al.
7,156,192 B2 1/2007 Guerrero et al.
7,172,026 B2 2/2007 Misselbrook
7,174,974 B2 2/2007 Bloom et al.
7,185,716 B2 3/2007 Bloom et al.
7,188,681 B2 3/2007 Bloom et al.
7,191,829 B2 3/2007 Bloom et al.
7,215,253 B2 5/2007 Baek et al.
7,222,682 B2 5/2007 Doering et al.
7,252,143 B2 8/2007 Sellers et al.
7,273,109 B2 9/2007 Moore et al.
7,275,593 B2 10/2007 Bloom et al.
7,303,010 B2 12/2007 de Guzman et al.
7,337,850 B2 3/2008 Contant
7,343,982 B2 3/2008 Mock et al.
7,353,886 B2 4/2008 Bloom et al.
7,392,859 B2 7/2008 Mock et al.
7,401,665 B2 7/2008 Guerrero et al.
7,493,967 B2 2/2009 Mock et al.
7,516,782 B2 4/2009 Sheiretov et al.
7,516,792 B2 4/2009 Lonnes et al.
7,604,060 B2 10/2009 Bloom et al.
7,607,495 B2 10/2009 Bloom et al.
7,607,497 B2 10/2009 Mock et al.
7,624,808 B2 12/2009 Mock

(56) References Cited

U.S. PATENT DOCUMENTS

| | | | | |
|---|---|---|---|---|
| 7,743,849 | B2 | 6/2010 | Kotsonis et al. | |
| 7,748,476 | B2 | 7/2010 | Krueger, V | |
| 7,770,667 | B2 | 8/2010 | Moore | |
| 7,775,272 | B2 | 8/2010 | Nelson et al. | |
| 7,784,564 | B2 | 8/2010 | Iskander et al. | |
| 7,832,488 | B2 | 11/2010 | Guerrero et al. | |
| 7,836,950 | B2 | 11/2010 | Vail, III et al. | |
| 7,854,258 | B2 | 12/2010 | Sheiretov et al. | |
| 7,857,067 | B2 | 12/2010 | Tunc et al. | |
| 7,886,834 | B2 | 2/2011 | Spencer et al. | |
| 7,896,088 | B2 | 3/2011 | Guerrero et al. | |
| 7,900,699 | B2 | 3/2011 | Ramos et al. | |
| 7,954,562 | B2 | 6/2011 | Mock | |
| 7,954,563 | B2 | 6/2011 | Mock et al. | |
| 8,028,766 | B2 | 10/2011 | Moore | |
| 8,061,447 | B2 | 11/2011 | Krueger | |
| 8,069,917 | B2 | 12/2011 | Bloom et al. | |
| 8,082,988 | B2 | 12/2011 | Redlinger et al. | |
| 8,151,902 | B2 | 4/2012 | Lynde et al. | |
| 8,245,796 | B2 | 8/2012 | Mock et al. | |
| 8,286,716 | B2 | 10/2012 | Martinez et al. | |
| 8,485,253 | B2 | 7/2013 | Jacob | |
| 8,485,278 | B2 | 7/2013 | Mock | |
| 8,555,963 | B2 | 10/2013 | Bloom et al. | |
| 8,579,037 | B2 | 11/2013 | Jacob | |
| 8,602,115 | B2 | 12/2013 | Aguirre et al. | |
| 8,944,161 | B2 | 2/2015 | Bloom et al. | |
| 9,228,403 | B1 | 1/2016 | Bloom et al. | |
| 9,447,648 | B2 | 9/2016 | Mitchell | |
| 9,988,868 | B2 | 6/2018 | Bloom et al. | |
| 2001/0045300 | A1 | 11/2001 | Fincher et al. | |
| 2002/0077971 | A1 | 1/2002 | Beaufort et al. | |
| 2002/0029908 | A1 | 3/2002 | Bloom et al. | |
| 2005/0145415 | A1 | 7/2005 | Doering et al. | |
| 2006/0180318 | A1* | 8/2006 | Doering | E21B 4/18 166/384 |
| 2007/0095532 | A1 | 5/2007 | Head et al. | |
| 2007/0261887 | A1 | 11/2007 | Pai et al. | |
| 2008/0061647 | A1 | 3/2008 | Schmitt | |
| 2008/0066963 | A1 | 3/2008 | Sheiretov et al. | |
| 2008/0073077 | A1 | 3/2008 | Tunc et al. | |
| 2008/0110635 | A1 | 5/2008 | Loretz et al. | |
| 2008/0196901 | A1 | 8/2008 | Aguirre et al. | |
| 2008/0202769 | A1 | 8/2008 | Dupree et al. | |
| 2008/0314639 | A1 | 12/2008 | Kotsonis et al. | |
| 2009/0008150 | A1 | 1/2009 | Lavrut et al. | |
| 2009/0071660 | A1 | 3/2009 | Martinez et al. | |
| 2009/0091278 | A1 | 4/2009 | Montois et al. | |
| 2009/0159295 | A1 | 6/2009 | Guerrero et al. | |
| 2009/0218105 | A1 | 9/2009 | Hill et al. | |
| 2009/0229820 | A1 | 9/2009 | Saeed | |
| 2009/0236101 | A1 | 9/2009 | Nelson et al. | |
| 2009/0294124 | A1 | 12/2009 | Patel | |
| 2009/0321141 | A1 | 12/2009 | Kotsonis et al. | |
| 2010/0018695 | A1 | 1/2010 | Bloom et al. | |
| 2010/0038138 | A1 | 2/2010 | Mock et al. | |
| 2010/0108387 | A1 | 5/2010 | Bloom et al. | |
| 2010/0108394 | A1 | 5/2010 | Ollerenshaw et al. | |
| 2010/0314131 | A1* | 12/2010 | Krueger, V | E21B 4/18 166/382 |
| 2012/0061075 | A1 | 3/2012 | Mock | |

FOREIGN PATENT DOCUMENTS

| | | |
|---|---|---|
| CA | 2 250 483 | 4/1999 |
| CA | 2 336 421 | 1/2006 |
| CA | 2 436 944 | 5/2012 |
| CA | 2 515 482 | 5/2013 |
| CA | 2 581 438 | 10/2015 |
| CA | 2 688 348 | 10/2015 |
| DE | 24 39 063 | 2/1976 |
| DE | 29 20 049 | 2/1981 |
| EP | 0 149 528 | 7/1985 |
| EP | 0 951 611 | 1/1993 |
| EP | 0 257 744 | 1/1995 |
| EP | 0 767 289 | 4/1997 |
| EP | 0 911 483 | 4/1997 |
| EP | 1 281 834 | 2/2003 |
| EP | 1 344 893 | 9/2003 |
| EP | 1 370 891 | 11/2006 |
| EP | 1 845 230 | 10/2007 |
| EP | 1 223 305 | 4/2008 |
| GB | 894 117 | 4/1962 |
| GB | 1 105 701 | 3/1968 |
| GB | 2 048 339 | 12/1980 |
| GB | 2 241 723 | 9/1991 |
| GB | 2 305 407 | 4/1997 |
| GB | 2 310 871 | 9/1997 |
| GB | 2 346 908 | 8/2000 |
| GB | 2 362 405 | 11/2004 |
| GB | 2 401 130 | 11/2004 |
| GB | 2 389 135 | 11/2005 |
| GB | 2 413 816 | 1/2006 |
| GB | 2 414 499 | 6/2006 |
| NO | 317476 | 11/2004 |
| NO | 328145 | 12/2009 |
| WO | WO 1989/05391 | 6/1989 |
| WO | WO 1992/13226 | 8/1992 |
| WO | WO 1993/18277 | 9/1993 |
| WO | WO 1994/27022 | 11/1994 |
| WO | WO 1995/21987 | 8/1995 |
| WO | WO 1998/01651 | 1/1998 |
| WO | WO 2000/36266 | 6/2000 |
| WO | WO 2000/46461 | 8/2000 |
| WO | WO 2000/63606 | 10/2000 |
| WO | WO 2000/73619 | 12/2000 |
| WO | WO 2002/44509 | 6/2002 |
| WO | WO 2004/072433 | 8/2004 |
| WO | WO 2005/057076 | 6/2005 |
| WO | WO 2007039025 | 4/2007 |
| WO | WO 2007134748 | 11/2007 |
| WO | WO 2008/061100 | 5/2008 |
| WO | WO 2008/104177 | 9/2008 |
| WO | WO 2008/104178 | 9/2008 |
| WO | WO 2008/104179 | 9/2008 |
| WO | WO 2008/128542 | 10/2008 |
| WO | WO 2008/128543 | 10/2008 |
| WO | WO 2009/062718 | 5/2009 |
| WO | WO 2010/062186 | 6/2010 |
| WO | WO 2011/005519 | 1/2011 |
| WO | WO 2013/063317 | 5/2013 |
| WO | WO 2015/112353 | 7/2015 |

OTHER PUBLICATIONS

PCT International Report on Patentability for PCT Application No. PCT/US2015/010889, dated Aug. 2, 2016.

"Kilobomac to Challenge Tradition" Norwegian Oil Review, 1988, pp. 50-52.

* cited by examiner

ECCENTRIC LINKAGE GRIPPER

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

This application claims the benefit of U.S. Provisional Patent Application No. 61/932,192, entitled "ECCENTRIC LINKAGE GRIPPER," filed on Jan. 27, 2014, U.S. Provisional Patent Application No. 61/933,755, entitled "ECCENTRIC LINKAGE GRIPPER," filed on Jan. 30, 2014, and U.S. Provisional Patent Application 61/954,372, entitled "ECCENTRIC LINKAGE GRIPPER," filed on Mar. 17, 2014, and U.S. patent application Ser. No. 14/222,310, entitled "ECCENTRIC LINKAGE GRIPPER," filed on Mar. 21, 2014, which are hereby incorporated by reference in their entirety.

FIELD OF THE INVENTION

The present application relates generally to gripping mechanisms for downhole tools.

DESCRIPTION OF THE RELATED ART

WWT International has developed many tools for anchoring down hole tools to the internal surface defining the bore hole. The various designs incorporate different features to allow the tool to operate in different internal diameter ("ID") ranges as well as specialize in different operations. The designs also incorporate features that are compatible with various collapsed tool outer diameter ("OD") constraints. For purposes of this application, a "throughfit OD" is defined as the smallest diameter circle through which the tool can be inserted.

WWT's grippers have included inflatable packer type grippers, roller/ramp expansion mechanisms in both fixed and "expandable" ramp configurations, linkages, and any combination of the these technologies. However, previous grippers have had issues operating in common cased and open hole diameters when constrained with very small collapsed tool OD's (i.e. 2.125"). Also, as the collapsed tool diameter shrinks, the gripper's ability to perform reliably in the varied bore hole conditions can suffer due to the smaller packaging of the critical load bearing elements in addition, very small grippers generally have extremely limited strength and thus typically limit the load capacity of the tractor. Also, many small grippers have a large number of small parts that are subject to contamination from well bore debris.

In one known design, a tractor comprises an elongated body, a propulsion system for applying thrust to the body, and grippers for anchoring the tractor to the inner surface defining a borehole or passage while such thrust is applied to the body. Each gripper has an actuated position in which the gripper substantially prevents relative movement between the gripper and the inner surface defining the passage using outward radial force, and a second, typically retracted, position in which the gripper permits substantially free relative movement between the gripper and the inner surface of the passage. Typically, each gripper is slidably engaged with the tractor body so that the body can be thrust longitudinally while the gripper is actuated.

SUMMARY OF THE INVENTION

One aspect of at least one embodiment of the invention is the recognition that it would be desirable to have a gripper configured to operate in relatively large bore holes when compared to the collapsed OD of the gripper. Even with the compromised design space of small OD, the Eccentric Linkage Gripper ("ELG") preferably maintains sufficient mechanical properties to ensure reliable operation. It is designed to work in conjunction with known bore hole conditions and minimize their detrimental effect on the gripper.

In some embodiments, an ELG gripper as described below has several advantages. These advantages include the ability to pass through small downhole restrictions and then significantly expand to operate is large cased wells or even larger open holes.

In one aspect, a method of moving a tool along a passage includes positioning a gripper in the passage, the gripper comprising a body defining an axis and a grip assembly coupled to the body, the grip assembly comprising a wall engagement portion, wherein said gripper is positioned eccentrically within said passage such that said axis of said body of said gripper is not placed centrally in the passage and exerting force on one side of the passage with the wall engagement portion of the grip assembly to propel said gripper within the passage. In some aspects, exerting force on one side of the passage with the wall engagement portion further comprises using links to exert force on one side of the passage. In some aspects, the wellbore defines a passage having a longitudinal passage axis and a longitudinal axis of the body is spaced from the longitudinal passage axis by an eccentric distance when the grip assembly is in an expanded configuration. In some aspects, a ratio of a radius of the passage to the eccentric distance is at least 3.

In one aspect, a gripper includes a body comprising a sliding portion and a grip assembly coupled to the body. The grip assembly comprises a wall engagement portion configured to grip an interior surface defining a wellbore. The wall engagement portion is extendable away from the sliding portion. The sliding portion is configured to slide along the interior surface defining the wellbore. In some aspects, the gripper further includes a plurality of extendable members. In some aspects, the gripper further includes a linkage. In some aspects, the wall engagement portion is defined by the linkage. In some aspects, the gripper further includes an actuator for causing the wall engagement portion to exert outward force. In some aspects, the actuator is within the body. In some aspects, the gripper is configured to slide along a bottom surface of a horizontal wellbore and grip a top surface of a horizontal wellbore. In some aspects, the sliding portion comprises at least one wheel.

In some aspects, a coefficient of friction between the sliding portion and the surface of the wellbore is less than 0.3. In some aspects, a coefficient of friction between the sliding portion and the surface of the wellbore is less than 0.5, less than 0.4, less than 0.3, and less than 0.2.

In some aspects, a ratio of an expanded throughfit OD of the gripper to a collapsed throughfit OD of the gripper is more than 2, more than 2.5, more than 2.75, more than 3, or more than 3.25. In some aspects, a maximum working operation expansion angle could be less than 85 degrees, less than 80 degrees, less than 75 degrees, less than 70 degrees, less than 60 degrees, or less than 50 degrees.

In another aspect, a method for moving a tool along a passage includes the steps of positioning a gripper in the passage, the gripper comprising a body comprising a sliding portion and a grip assembly coupled to the body, the grip assembly comprising a wall engagement portion; exerting force on one side of the passage with the wall engagement portion of the grip assembly; and sliding the body along another side of the passage due to a resultant force from the exerting force.

In yet another aspect, a gripper assembly includes a link mechanism including a lower link connector connected to a first push link and a second push link, the lower link connector slidably attached to an elongate body, a load link rotatably attached to the elongate body, an upper link connector rotatably connected to the first and second push links and the load link, and an expansion surface upon which the first and second push links act to provide an expansion force. For a first expansion range, the movement of the first and second push links upon the expansion surface expands the linkage and for a second expansion range the movement of the first and second push links pushing against a first end of the upper link connector expands the linkage. In some aspects, the first push link, the second push link, the upper link connector, and the lower link connector form an approximately parallelogram shape when the link mechanism is expanded. In some aspects, the ratio of a length of the first push link to a length of the second push link is approximately 1. In some aspects, a maximum angle of the load link with respect to the elongate body does not exceed 80 degrees.

In another aspect, a gripper includes a body comprising a first side that defines a translating contact surface and a second side that defines a wall engagement portion. The wall engagement portion is configured to grip an interior surface defining a wellbore and propel the gripper by engaging with the interior surface defining a wellbore, said wall engagement portion extendable away from the second side and said contact surface is configured to translate along the interior surface defining the wellbore. In some aspects, the first side is passive. In some aspects, the first side defines a line of movement along which the contact surface of the gripper translates along the interior surface defining the wellbore. In some aspects, the first side defines three points of contact between the gripper and the interior surface defining the wellbore. In some aspects, the first surface further comprises at least one wheel. In some aspects, the gripper further includes a plurality of extendable members. In some aspects, the gripper further includes a linkage. In some aspects, the wall engagement portion is defined by the linkage.

DETAILED DESCRIPTION OF THE PREFERRED EMBODIMENT

Overview—Eccentric Linkage Gripper

The Eccentric Linkage Gripper ("ELG") operates by utilizing a linkage assembly on one side of an elongate body and a sliding portion on an opposite side of the elongate body. The ELG gripper uses the moment of the force applied to an interior surface defining a bore hole to move the gripper along an opposite interior surface defining the bore hole. In some embodiments, including the illustrated embodiments, the eccentric linkage assembly acts on an inside surface of a well bore. The force exerted on the well bore causes the sliding portion of the ELG to slide along an opposite interior surface of the well bore to move the ELG in the predetermined direction of travel. The ELG has also been designed to preferably provide enough mechanical advantage to enable the gripper to function on very low input forces from a linear force actuator. The gripper is desirably eccentrically positioned in the bottom (low side) of the bore hole which enables the gripper to operate in wider ranges diameters as well as minimizing the effects of varying friction factors of different regions of the bore hole diameter. In the ELG, the actual linkage assembly preferably transmits the radial forces to the bore hole wall in the most favorable orientation.

Eccentric Linkage Gripper Assembly

The ELG can be a stand-alone subassembly that can be preferably configured to be adaptable to substantially all applicable tractor designs. In some embodiments, a spring return, single acting hydraulic cylinder actuator 220 can provide an axial force to a linkage 12 to translate into radial force. As with certain previous grippers, the ELG gripper may allow axial translation of a tractor shaft while the gripping section 14 engages the hole or casing wall.

Figure 1:
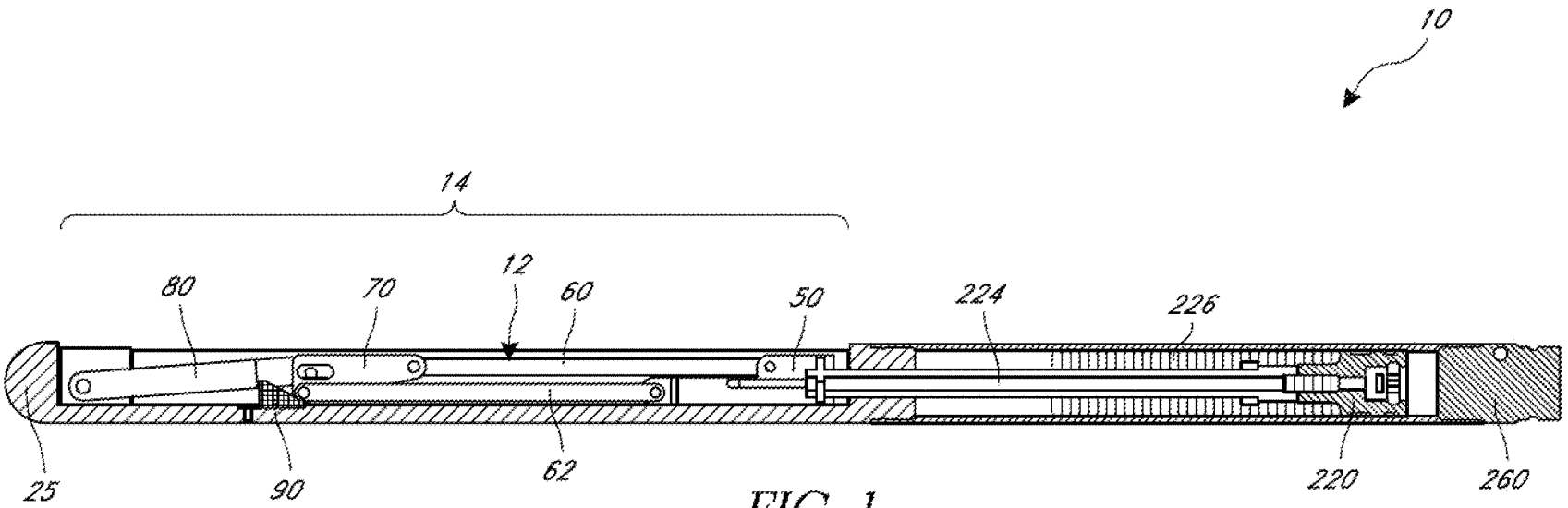
FIG. 1 is a cross section illustration of the ELG gripper when in its collapsed state according to one embodiment.

FIG. 1 illustrates a cross-section of one embodiment of an ELG when the ELG is in a collapsed state. In some embodiments, the ELG gripper 10 can comprise three subassemblies: a power section or actuator 220, an expandable gripping section 14, and a sliding section 86. For ease of discussion, these subassemblies are discussed separately below. However, it is contemplated that in other embodiments of the ELG gripper, more or fewer subassemblies could be present and the actuator 220, expandable gripping section 14 and sliding section 86 can be integrated such that it is difficult to consider each as separate subassemblies. As used herein, "actuator," "expandable gripping section," and "sliding section" are broad terms and include integrated designs. Furthermore, in some embodiments an expandable gripping section 14 can be provided apart from an actuator 220 such that the expandable gripping section 14 of the ELG gripper 10 described herein can be fit to existing actuators of existing tractors, for example single or double-acting hydraulic piston actuators, electric motors, or other actuators.

Figure 4:
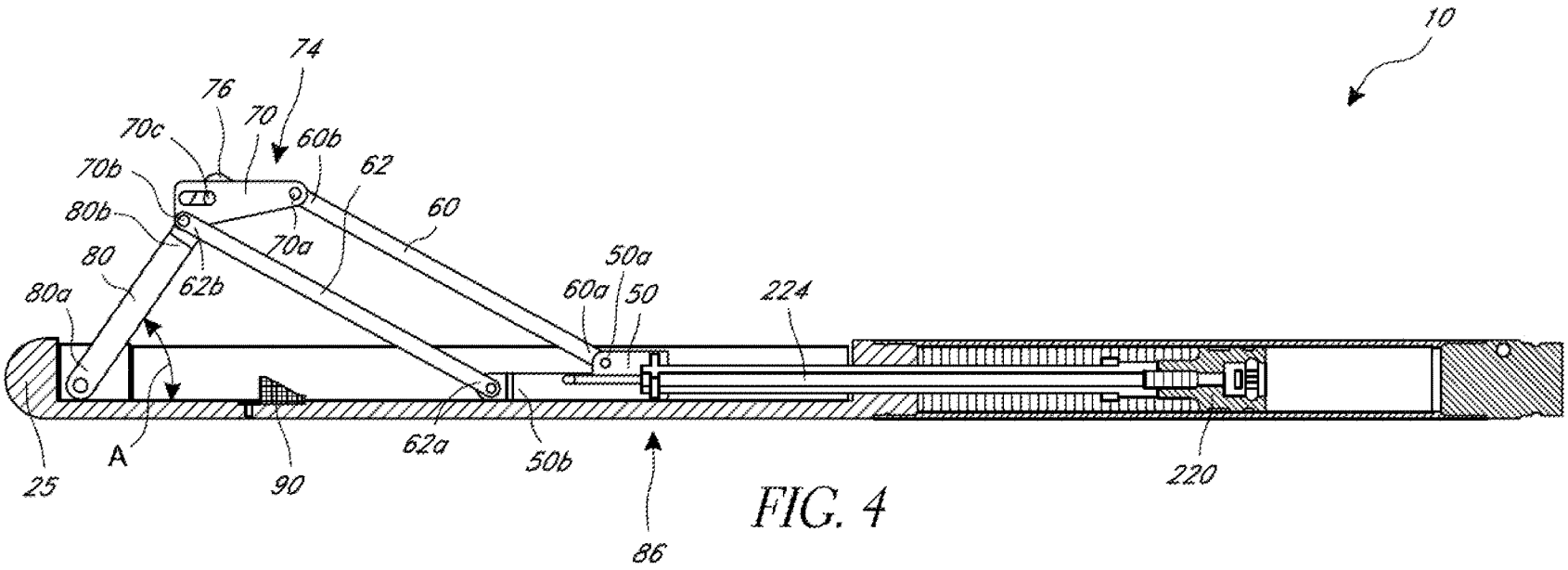
FIG. 4 is a cross section illustration of the ELG at the beginning of its working operational expansion range.

With continued reference to FIG. 1 and also with reference to FIG. 4, in the illustrated embodiment, the linkage 12 of the gripping section 14 comprises extendable gripping and propelling members such as a lower link connector 50, a first push link 60, a second push link 62, an upper link connector 70, and a load link 80. The first and second push links 60 and 62 are rotatably connected to the lower link connector 50, such as by a pinned connection. The first and second push links 60 and 62 are also rotatably connected to the upper link connector 70, such as by a pinned connection. The load link 80 is rotatably connected to the upper link connector 70, such as by a pinned connection. The load link 80 is also rotatably connected to an elongate body 25 such as by a pinned connection.

In the illustrated embodiments shown most clearly in FIG. 4, a first end 60*a* of the first push link 60 is rotatably connected to the lower link connector 50 at a first lower link connector attachment point 50*a*. A first end 62*a* of the second push link 62 is rotatably connected to the lower link connector 50 at a second lower link connector attachment point 50*b*. In some embodiments, including the illustrated embodiment, the lower link connector 50 may be shaped such that the two attachment points 50*a* and 50*b* of the lower link connector 50 are located at positions along the longitudinal length of the ELG gripper 10. In other words, in some embodiments the second lower link connector attachment point 50*b* may be located closer to the connection between the load link 80 and the elongate body 25.

With continued reference to FIG. 4, a second end 60*b* of the first push link 60 is rotatably connected to the upper link connector 70 at a first upper link connector attachment point 70*a*. A second end 62*b* of the second push link 62 is rotatably connected to the upper link connector 70 at a second upper link connector attachment point 70*b*. The push links 60 and 62 are rotatably connected to the lower link connector 50 and the upper link connector 70 such that the push links 60 and 62 are substantially parallel when the linkage 12 is in an expanded configuration such as that shown in FIG. 4. Additionally, in some embodiments, including the illustrated embodiment, the push links 60 and 62, along with the upper link connector 70 and the lower link connector 50, form a substantially parallelogram shape when the linkage 12 is in an expanded configuration as shown in FIG. 4. In some embodiments, including the illustrated embodiment, the push links may be at least 5 inches in length, at least 6 inches in length, or at least 7 inches in length. In some embodiments, the upper link connector may be least 2 inches in length, at least 3 inches in length or at least 4 inches in length. In some embodiments, including the illustrated embodiment, the lower link connector may be at least 3 inches in length, at least 4 inches in length, or at least 5 inches in length. In some embodiments, including the illustrated embodiment, and as will be discussed in greater detail below, the lower link connector 50 can be axially slideable with respect to the elongate body 25 along a distance of the body.

With continued reference to FIG. 4, a first end 80*a* of the load link 80 is rotatably connected to the elongate body 25. A second end 80*b* of the load link 80 is rotatably connected to the upper link connection 70 at a load link attachment point 70*c*. The tip 76 of the second end 80*b* of the load link 80 is preferably serrated or grooved to provide an interface for gripping the interior surface of the well bore. In some embodiments, including the illustrated embodiment, the area of the linkage that interacts with the bore hole wall is preferably serrated to facilitate gripping against a hard surface, such as casing. In some embodiments, including the illustrated embodiment, the serrated end 76 of the load link 80 may extend above the surface 74 of the upper link connector 70 to provide a serrated pressure area to act against the bore hole wall. In some embodiments, including the illustrated embodiment, the ratio of the total area of the surface 74 of the upper link connector to the area of the serrated end 76 of the load link 80 is preferably at least 4, at least 6, at least 8, or at least 16. In some embodiments, including the illustrated embodiment, the upper link connector 70 may be interchangeable with another upper link connector 70 having a longer or shorter length, resulting in a larger or smaller upper surface 74. Therefore, in some embodiments, including the illustrated embodiment, the total area of the upper link connector 70 applied to the formation surface is adjustable such that the tractor load applied over the total load area is equal to or less than the compressive stress of the formation at the location where force from the gripper 10 is applied. In other words, the upper link connector 70 can be sized depending on the hardness or softness of the formation to prevent excessive penetration of the linkage 12 into the formation. Similarly, to accommodate any change in geometry due to a change in size of the upper link connector 70, the push link 60 may also be longer or shorter. One set of linkages may be installed in the gripper 10 at the time of manufacture. The linkage 12 may be switched in the field to an appropriately sized upper link connector 70 and push link 60, depending on operation conditions.

In some embodiments, including the illustrated embodiment shown in FIG. 4, the elongate body 25 may include a ramp 90. As will be discussed in greater detail below, the ramp 90 preferably facilitates the expansion of the linkage 12. In some embodiments, a roller 92 (FIG. 3) may be disposed at the second end 62*b* of the push link 62 such that the second end 62*b* of the push link 62 can roll up the ramp 90 during expansion of the linkage 12. Operation of the eccentric linkage gripper will be discussed in greater detail below.

The ELG gripper 10, as shown in FIG. 4, also comprises an engagement or sliding surface section 86. In some embodiments, including the illustrated embodiment, the sliding section 86 is located on a side of the elongate body 25 opposite the linkage 12. In other words, one side of the ELG gripper 10 grips or propels the gripper 10 via linkage 12 and the side opposite the linkage 12 defines an engagement or sliding surface section 86 that slides or rolls along an interior surface defining a bore hole. Desirably, the sliding section 86 provides a substantially smooth surface that can slide along the interior surface of the formation or casing in response to a gripping force exerted by the linkage 12 and the power section 220, as will be discussed in further detail below. The sliding section 86 may be integrated into the elongate body 25 or may be a separate component. In some embodiments, the sliding section 86 may also comprise one or more wheels that can roll along the interior surface defining a bore hole in response to a gripping force exerted by the linkage 12. In some embodiments, including the illustrated embodiment, desirably the side of the gripper 10 comprising the linkage 12 is actively propelling and gripping the interior surface defining the bore hole and the opposite side of the gripper 10 comprising the sliding section 86 is passively translating along the interior surface defining the bore hole. The sliding section 86 is preferably a smooth surface able to translate along, above, and/or through any debris that along the interior surface defining the bore hole. In some embodiments, including the illustrated embodiment shown in FIG. 7A, at least two points 87 and 88 define a line of movement along which the gripper 10 translates along the interior surface 98 defining the bore hole. Preferably, at least three points 87, 88, and 89 define a three points of contact between the gripper 10 and the interior surface 98 defining the bore hole such that the gripper 10 does not rotate from side to side while translating along the interior surface 98 defining the bore hole.

Figure 2:
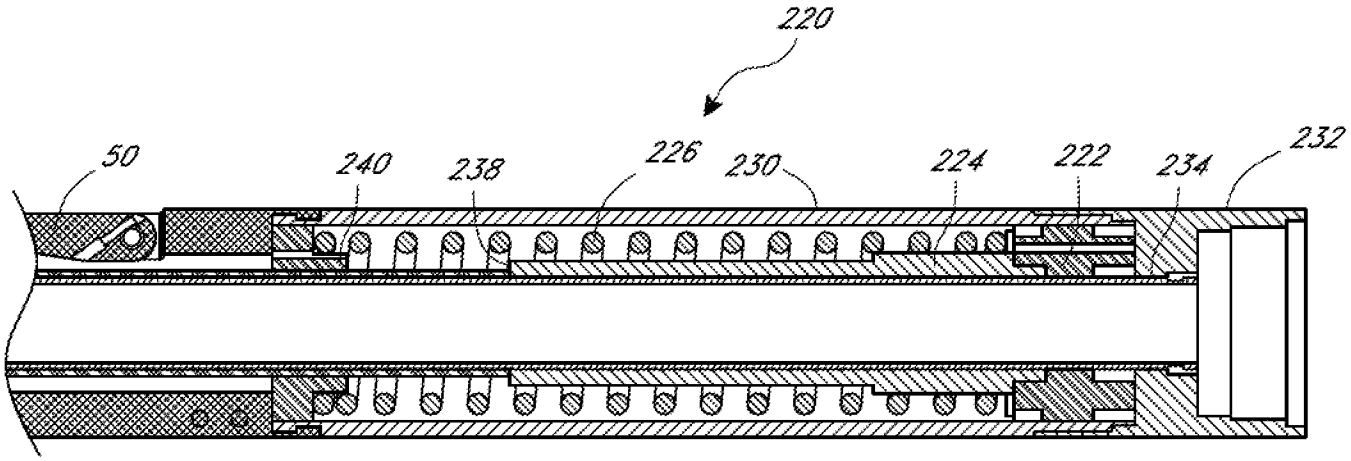
FIG. 2 is a cross-sectional side view of an actuator of the gripper assembly of FIG. 1.

With reference to FIG. 2, and as further described below, in certain embodiments, the gripper 10 can include power section or actuator 220 to actuate the grip assembly between a collapsed state and an expanded state. In some embodiments, the power section 220 can comprise hydraulically-actuated piston 222-in-a-cylinder 230. A piston force generated within the cylinder 230 of the ELG gripper 10 may advantageously start the gripper expansion process. As discussed in greater detail below, this force can desirably be conveyed through piston rod 224 to thrust the lower link connector 50 axially towards the load link 80. In some embodiments, such as the embodiment shown in FIG. 3, a roller 92 attached to the push link 62 can extend up an expansion surface such as defined by the ramp 90. This expansion surface can exert an expansion force on the link connection, which in turn exerts an expansion force on an inner surface of a formation or casing that the linkage is in contact with. As discussed in greater detail below, at greater expansion diameters, the links of the linkage 12 can depart the expansion surface.

Additionally, the entire specification of U.S. Pat. No. 7,748,476, entitled "VARIABLE LINKAGE GRIPPER," including the drawings and claims, is incorporated hereby by reference in its entirety and made a part of this specification.

With respect to FIG. 2, a cross-sectional view of an embodiment of actuator 220 of the ELG gripper 10 is illustrated. In the illustrated embodiment, the actuator 220 comprises a single acting, spring return hydraulically powered cylinder. Preferably, a single hydraulic source actuates the actuator 220. Desirably, hydraulic fluid will flow from a single hydraulic source into the piston actuating the linkage. Thus, in the illustrated embodiment, the piston 222 can be longitudinally displaced within the cylinder 230 by a pressurized fluid acting on the piston 222. Pressurized fluid media is delivered between a gripper connector 232 and the piston 222. The fluid media acts upon an outer diameter of the mandrel 234 and an internal diameter of the gripper cylinder 230, creating a piston force. Referring to FIG. 2, the piston force acts upon the piston 222 with enough force to axially deform a return spring 226. The piston 222 is connected to a piston rod 224 which acts on the lower link connector 50. The piston 222 can continue axial displacement with respect to the mandrel 234 with an increase in pressure of the supplied fluid until an interference surface 238 defining a stroke limiting feature of the piston rod 224 makes contact with a linkage support 240.

In other embodiments, the actuator 220 can comprise other types of actuators such as dual acting piston/cylinder assemblies or an electric motor. The actuator 220 can create a force (either from pressure in hydraulic fluid or electrically-induced rotation) and convey it to the expandable gripping section 14. In other embodiments, the expandable gripping section 14 can be configured differently such that the gripping section 14 can have a different expansion profile.

Figure 3:
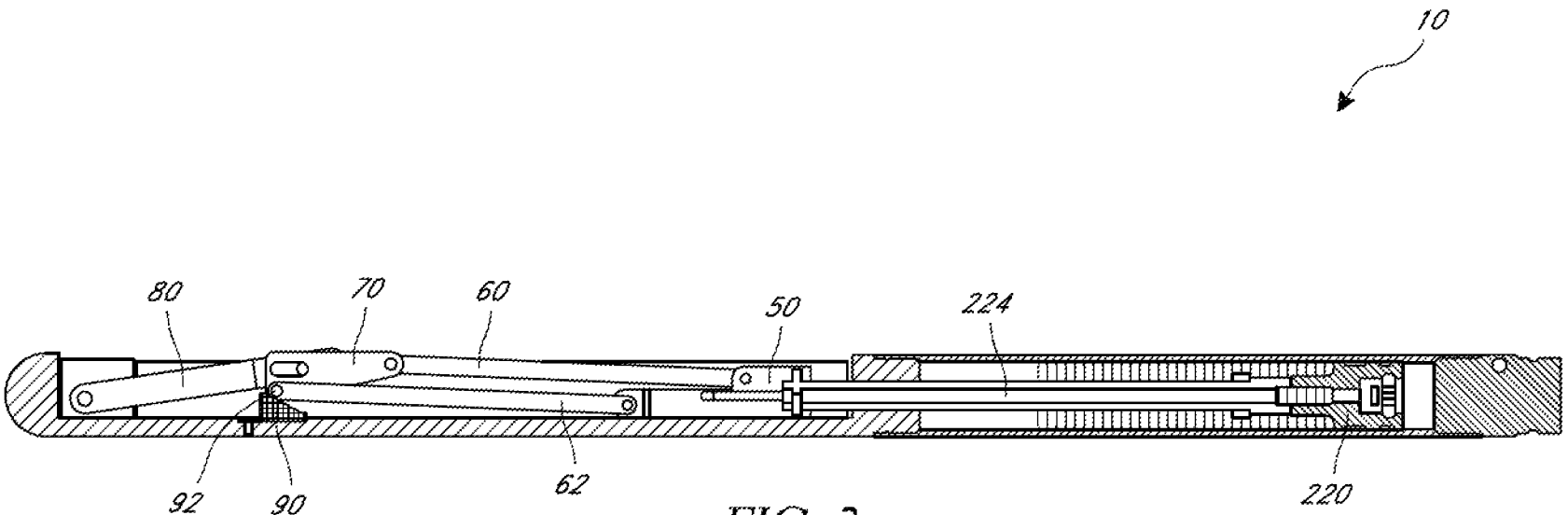
FIG. 3 is a cross section illustration of the ELG during the initial phase of expansion.
Figure 8A:
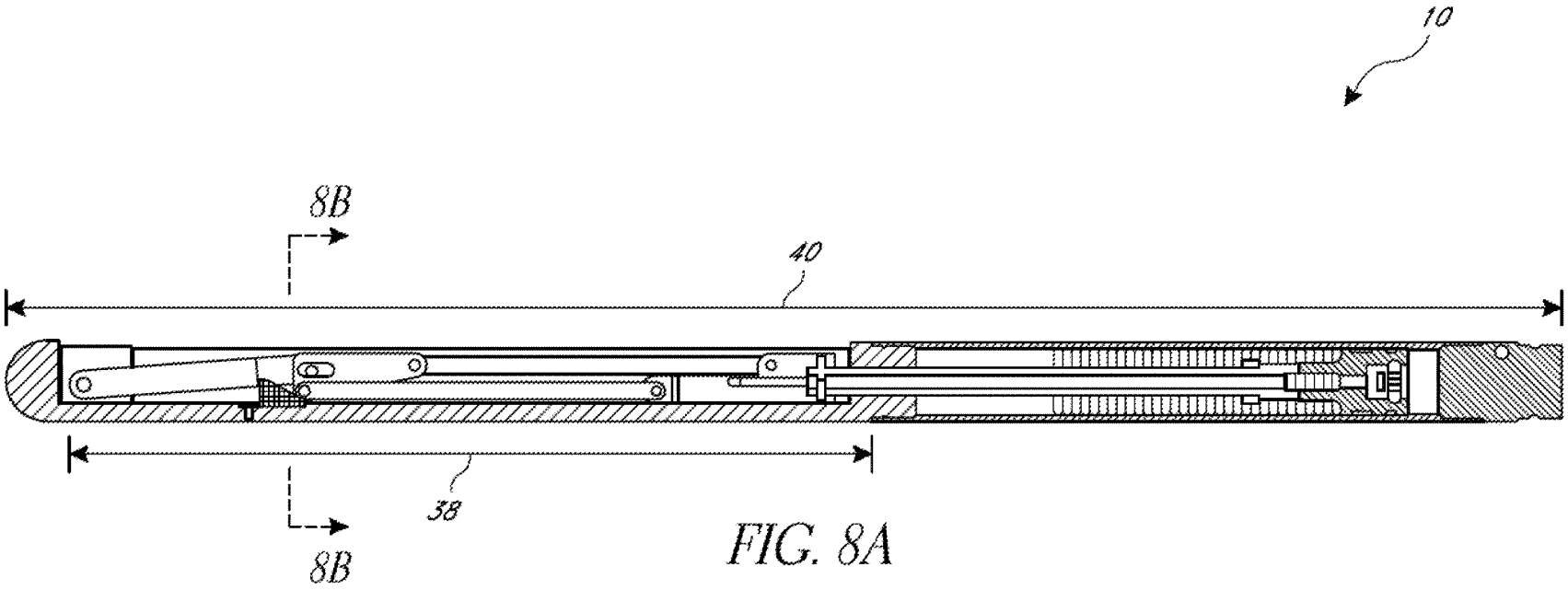
FIG. 8A is a side cross-section of the ELG in a collapsed position illustrating the cross-sectional area of the gripper element as compared to the total cross-sectional area of the gripper assembly.

FIGS. 3 and 8A illustrate an embodiment of the ELG gripper 10 in a collapsed configuration. When the illustrated embodiment of the ELG gripper 10 is incorporated in a tractor, an elongate body 25 or mandrel of the tractor is attached to the gripper connector 232 and the mandrel cap 260. The ELG gripper 10 includes an internal mandrel 234 which extends between the gripper connector 232 and the mandrel cap 260 during the expansion process and can provide a passage for the pressurized fluid media to the actuator 220 when the piston is positioned within the cylinder (FIG. 2) at any location along the mandrel 234. In the illustrated embodiment, the piston rod 224 connects the actuator 220 to the expandable gripping section 14 of the ELG gripper 10.

Figure 5:
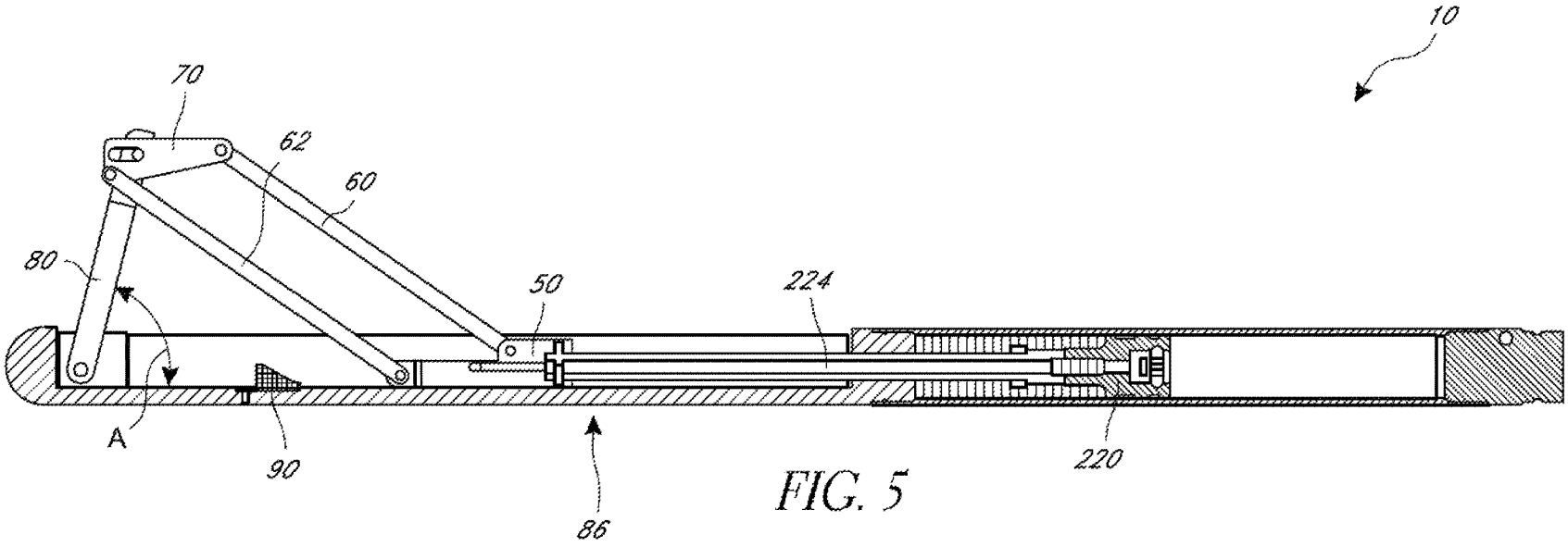
FIG. 5 is a cross section illustration of the ELG at the end of its working operation expansion range.
Figure 7A:
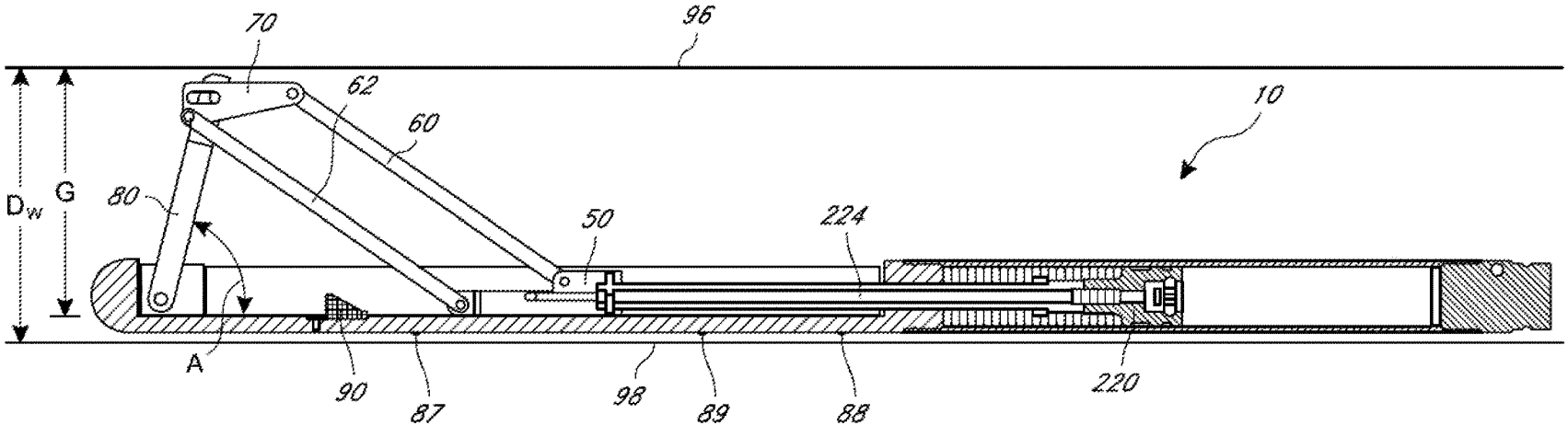
FIG. 7A is a side cross-section of the ELG in an expanded position within a wellbore.

In the illustrated embodiment, when the ELG gripper 10 is expanded, as shown in FIGS. 5 and 7A, the expandable gripping section 14 converts the axial piston force of the actuator 220 to radial expansion force. The linkage 12 expands, transmitting the radial expansion force to the formation or casing of the bore hole or passage. In some embodiments, the linkage 12 may act on the formation or casing of the bore hole through a serrated interface 76.

Operation Description of the Eccentric Linkage Gripper

With reference to FIG. 1, in the illustrated embodiment, the ELG gripper 10 is biased into a collapsed state. When pressure is not present in the actuator 220, the return spring 226 can exert a tensile force on the link members 60, 62, and 80. This tensile force can keep the links 60, 62, and 80 in a flat position substantially parallel to the elongate body and longitudinal axis of the ELG gripper 10. In some embodiments, a fail-safe action could be included such that when pulling on the ELG gripper 10 with a specific high force, an engineered break away section of the elongate body 25 located between the pinned connection between the load link 80 and the elongate body 25 and the lower link connector 50 preferably enables the linkage 12 of the gripper 10 to disengage the bore hole and continue to collapse.

An expansion sequence of the ELG gripper 10 from a fully collapsed or retracted position to a fully expanded position is illustrated sequentially in FIGS. 3-6. An embodiment of the ELG gripper 10 in a first stage of expansion is illustrated in FIG. 3. With reference to FIG. 3, in some embodiments, the expansion surface comprises an inclined ramp 90 having a substantially constant slope. In other embodiments, the expansion surface can comprise a curved ramp having a slope that varies along its length. As shown in FIG. 3, as the actuator 220 axially translates the piston rod 224, the push links 60 and 62 are advanced up the ramp 90 of the expansion surface. This preferably ensures that the linkage 12 is buckled in the correct orientation and in a controlled manner. When the ELG gripper 10 is expanded in a well bore formation or casing, the serrated end 76 of the load link 80 can apply the radial expansion force to the formation or casing wall. During this initial phase of expansion, preferably substantially all of the radial expansion forces generated by the ELG gripper 10 are borne by the push links 60 and 62 moving along the ramp 90. In some embodiments, including the illustrated embodiment, the elongate body 25 and the ramp 90 are desirably configured such that debris is not trapped within the elongate body 25 and around and upon the ramp 90 in such a way as to interfere with the ramp-link operation of the gripper 10.

In the illustrated embodiments, the initial phase of expansion described above with respect to FIG. 3 can continue until the actuator 220 advances the piston rod 224 such that the second end 62*b* of the push link 62 reaches an expanded end of the ramp 90, and a second stage of expansion begins, as illustrated in FIG. 4. Once the second end 62*b* of the push link 62 has reached the expanded end of the ramp 90, the actuator 220 desirably continues to exert force on the push links 60 and 62 via axial translation of the piston rod 24 and the lower link connector 50. Continued application of force by the actuator 220 further radially expands and buckles the links 60, 62, and 80 with respect to the elongate body 25, as shown in FIG. 4. Desirably, the push link 60 acts on the upper link connector 70 at the first upper link connector attachment point 70*a* and the push link 62 acts on the load link 80 and the upper link connector 70 at the second upper link connector attachment point 70*b* to radially expand the load link 80 and the upper link connector 70. In the illustrated embodiment, this continued expansion of the linkage 12 radially expands the linkage such that the ELG gripper 10 can apply a radial expansion force to a formation or casing wall. Desirably, the push links 60 and 62, the upper link connector 70, and the lower link connector 50 form a substantially parallelogram shape as the linkage 12 is radially expanded. The parallelogram created by the push links 60 and 62, upper link connector 70, and lower link connector 50 preferably prevents the load link 80 from over penetrating into soft open hole formations via the substantially flat top surface of the upper link connector 70 which provides a large surface contact area with the formation or casing wall. The pressure area of the serrated interface 76 on the load link 80 is preferably specially designed to be small to increase traction. However, once the serrations of the serrated interface 76 plunge into the formation, the pressure area acting on the formation preferably drastically increases as the top surface 74 of the upper link connector 70 makes contact with the bore hole wall. Further penetration of the load link 80 into the soft open hole formation is preferably prevented by the contact between the top surface 74 of the upper link connector 70.

At the beginning of the working operational expansion range, as shown in FIG. 4, desirably the angle A between the elongate body 25 and the load link 80 is approximately 50 degrees. In other embodiments, including the illustrated embodiment, the angle between the elongate body 25 and the load link 80 at the beginning of the working operational range of the linkage 12 may be approximately 45 degrees, approximately 50 degrees, approximately 55 degrees, or approximately 60 degrees. In some embodiments, including the illustrated embodiment, when the OD of the ELG gripper 10 is approximately 2.125", an angle A of 50 degrees equals approximately a 6.1" expansion diameter. In some aspects, a maximum working operation expansion angle A could be less than 80 degrees, less than 75 degrees, less than 70 degrees, less than 60 degrees, or less than 50 degrees.

The ELG gripper 10 is preferably designed to operate over a range of expansion angles A between 50 and 75 degrees. The variation in the length of the links is very large so the ratios of the expanded OD to collapsed OD are large. The current design has demonstrated expansion from approximately 2⅛ inches to approximately 10 inches with a range of expansion angles A from 50-75 degrees. For expansion angles A below approximately 45 degrees, the gripper 10 does not have sufficient grip to pull 2000 lbs. For expansion angles A greater than approximately 80 degrees, excessive loads may be placed on the links, potentially causing the links to fail.

FIG. 5 illustrates the ELG gripper 10 at a maximum radial expansion or at the end of the working operational expansion range. Maximum radial expansion of the linkage 12 is controlled by a mechanical stop of the linear force actuator 220. Maximum radial expansion of the linkage 12 desirably occurs when the angle A between the elongate body 25 and the load link 80 is between about 45 and 85 degrees and more desirably between about 50 and 75 degrees. In some embodiments, including the illustrated embodiment, maximum expansion of the linkage 12 occurs when the angle A between the elongate body 25 and the load link 80 is at least 65 degrees, at least 70 degrees, at least 75 degrees, or at least 80 degrees. In some embodiments, including the illustrated embodiment, maximum expansion of the linkage 12 occurs when the angle A between the elongate body 25 and the load link 80 is at a maximum angle of 65 degrees, more desirably at a maximum angle of 70 degrees, or most desirably at a maximum angle of 75 degrees. In some embodiments, when the ELG gripper 10 is at a maximum expansion at the end of the working operational range, the expansion diameter of the ELG gripper 10 is approximately 7.4" for an ELG gripper 10 having an OD of approximately 2.125". In some embodiments, the expansion diameter of the ELG gripper 10 at the maximum expansion point is at least 4", more desirably at least 5", more desirably at least 6", and most desirably at least 7".

The configuration of the linkage 12 and the relative lengths of the links 60, 62, and 80, and the position and height of the ramp 90 can determine the expansion ranges for which the primary mode of expansion force transfer is through the ramp 90 to the push links 60 and 62 interface and the expansion range for which the primary expansion force is generated by the buckling of the push links 60 and 62 and the load link 80 by the piston rod 224 of the actuator 220.

In some embodiments, where the ELG gripper 10 can be used for wellbore intervention in boreholes having relatively small entry points and potentially large washout sections, it can be desirable that a collapsed outer diameter of the ELG gripper 10 is approximately 3 inches and an expanded outer diameter is approximately 15 inches, thus providing a total diametric expansion, defined as a difference between the expanded outer diameter and the collapsed outer diameter, of approximately 12 inches. In some embodiments, including the illustrated embodiment, the total diametric expansion of the gripper assembly 10 can be at least 10 inches, at least 12 inches, or at least 15 inches. Desirably, in some embodiments, including the illustrated embodiment, an expansion range (that is, the distance between the outer diameter of the gripper 10 in a collapsed state and the outer diameter of the gripper 10 in an expanded state) can be between 2 inches and 5 inches, between 2 inches and 6 inches, between 3 inches and 5 inches, between 3 inches and 6 inches, between 3 inches and 7 inches, between 3 inches and 8 inches, between 3 inches and 10 inches, between 3 inches and 12 inches, between 3 inches and 15 inches or between 3 inches and 18 inches. In some embodiments, including the illustrated embodiment, the ELG gripper 10 can have an outer diameter in a collapsed position of less than 5 inches, less than 4 inches, or less than 3 inches. In some embodiments, including the illustrated embodiment, the ELG gripper 10 can have an outer diameter in an expanded position of at least 10 inches, at least 12 inches, at least 15 inches, or at least 17 inches. In certain embodiments, it can be desirable that an expansion ratio of the ELG gripper 10, defined as the ratio of the outer diameter of the ELG gripper 10 in an expanded position to the outer diameter of the ELG gripper 10 in a collapsed position, is at least 6, at least 5, at least 4.2, at least 4, at least 3.4, at least 3, at least 2.2, at least 2, at least 1.8 or at least 1.6. Desirably, in some embodiments, including the illustrated embodiment, the ELG gripper 10 has an expansion ratio of at least one of the foregoing ranges and a collapsed position to allow the gripper 10 to fit through a wellbore opening having a diameter no greater than 7 inches, a diameter no greater than 6 inches, a diameter no greater than 5 inches, or a diameter no greater than 4 inches. Desirably, in some embodiments, including the illustrated embodiment, the ELG gripper 10 has an expansion ratio of at least 3.5 and a collapsed position to allow the gripper 10 to fit through a wellbore opening having a diameter no greater than 7 inches, a diameter no greater than 6 inches, a diameter no greater than 5 inches, or a diameter no greater than 4 inches.

It can be desirable that in certain embodiments, the ramp has a height at the expanded end thereof relative to the ELG gripper 10 body from between approximately 0.3 inches to approximately 1 inch, and more desirably from 0.4 inches to 0.6 inches, such that for a diameter of the ELG gripper 10 from approximately 3.7 inches to up to approximately 5.7 inches, and desirably, in some embodiments, up to approximately 4.7 inches, the primary mode of expansion force transfer is through the rollers 104 to ramp 90 interface. At expanded diameters greater than approximately 5.7 inches, or, in some embodiments desirably approximately 4.7 inches, the primary mode of expansion force transfer is by continued buckling of the linkage 12 from axial force applied to the lower link connector 50 and the first ends of the push links 60 and 62.

Figure 6:
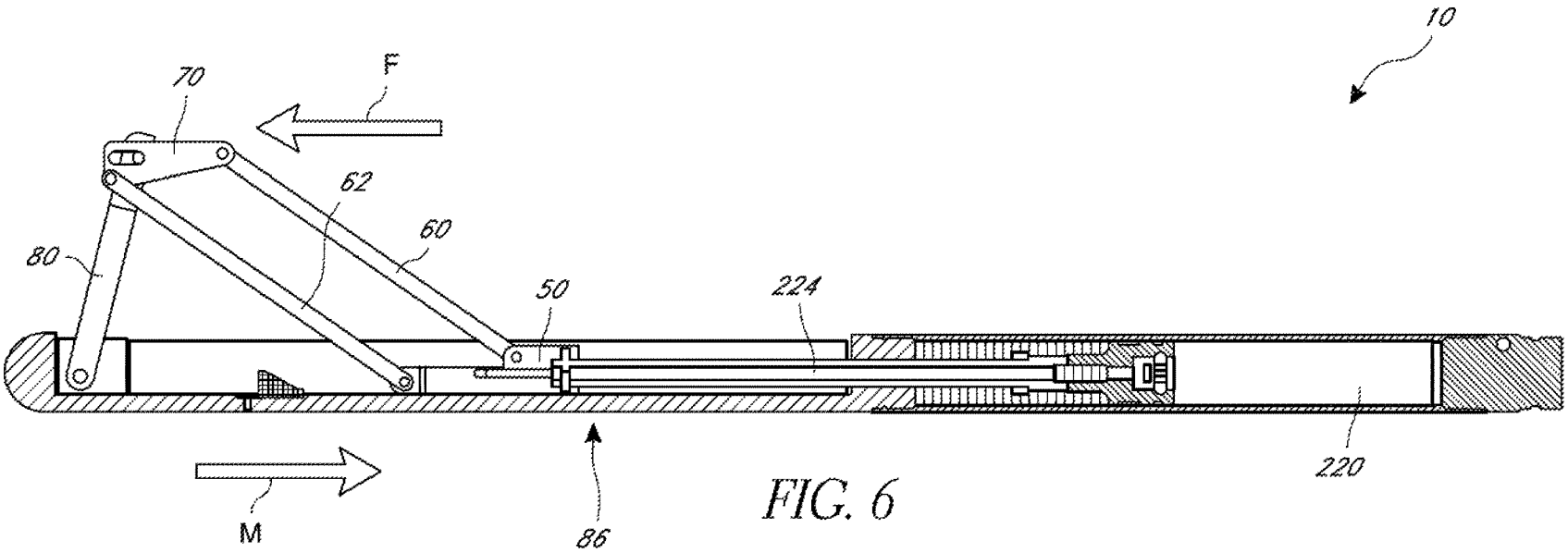
FIG. 6 is a cross section illustration of the ELG showing the movement of the ELG during operation.

With reference to FIG. 6, the mechanical advantage of the ELG gripper 10 is illustrated. Because mechanical advantage is the driving force behind the function of the ELG gripper 10, preferably very little input force is required from the actuator 220. The primary purpose of the actuator 220 is to provide just enough input force to keep the load link 80 erect and within the operational range. A pressure control device housed within the actuator 220 preferably maintains this pressure. Minimum pressure is desired as the ELG gripper 10 is designed to preferably never deflate or collapse during normal operation. This preferably results in a faster cycle time which is important when dealing with small OD tools in relatively large ID bore holes.

To convey a tractor, or any down hole tool, forward within a formation, the gripper is preferably pushed down hole while inflated or expanded or partially expanded. When the tractor pulls against the ELG gripper 10, the tractor force activates the linkage 12 and preferably ensures that the gripper 10 will remain engaged if the bore hole diameter falls within the operational range of the ELG gripper 10.

During activation of the singular linkage assembly, the ELG gripper 10 will preferably eccentrically position itself at the low side of the bore hole. This positioning provides several advantages.

First, WWT International grippers are used primarily in down hole tractors. Down hole tractors are frequently utilized in horizontal well bores. In horizontal well bores, both cased and open hole, accumulations of well bore debris fall to the low side of the well bore and tend to reduce "traction" for gripping mechanisms. This is due to the reduction in shear strength of the accumulated debris on the low side in comparison with the exposed section of open or cased hole on the top section (high side). The resultant differences in friction factors of the top and bottom sections of the well bore load concentric grippers in a non-symmetrical fashion. This non-symmetrical loading often requires elements of the gripper or expansion elements to be over-engineered (larger cross sections and overall mechanical properties). This is often not an option when designing very small collapsed OD tools. The ELG gripper illustrated in FIG. 6 is designed to operate within these known conditions as the bottom of the elongate body 25 is substantially smooth and designed to slide on the debris easily. The sliding gripper body 25 and resultant relative motion provides the input force to engage the load link 80 with the pulling force provided by the down hole tractor. Also, due to the eccentric positioning, the load link 80 will preferably interface with the high side of the bore hole, traditionally where the friction factors are highest. FIG. 6 illustrates these forces.

As the linkage 12 activates and engages the well bore formation or casing, an input force F is applied. As a result of this input force F, the sliding portion 86 of the gripper 10 slides along the lower surface of the formation in the direction M. After sliding along the formation in response to the input force F, the linkage 12 may be reset by partially collapsing and then expanding to exert force against the formation, resulting in another sliding translation of the gripper 10 along the opposite surface of the formation. This process may continue to incrementally move the gripper 10 and any connected well bore tools along the formation. This results in a gripper 10 with a fast cycling time due to not requiring a full collapse of the linkage 12 during operation.

In some embodiments, including the illustrated embodiment, the sliding portion 86 of the ELG gripper 10 may be constructed of different external materials from the elongate body 25. In some embodiments, including the illustrated embodiment, coatings such as a polymer, may be applied to the sliding portion 86 to control sliding and reduce friction. Depending on well conditions, the sliding portion 86 may be comprised of low friction materials to reduce friction in wells with excessive debris and associated high sliding friction. For wells with very low friction, such as cased wells with reduced friction due to the well fluid, coatings may be applied to the sliding portion 86 to increase friction on the sliding portion and facilitate controlled sliding of the gripper 10.

Additionally, the ELG gripper 10 having a sliding portion 86 is designed to work with known down hole conditions including debris accumulation on the low side of the formation. The sliding portion 86 desirably allows the ELG gripper 10 to slide over and through this debris with very little friction. In some embodiments, a coefficient of friction between the sliding portion 86 and the surface of the wellbore 98, as shown in FIG. 7A, can range from 0.25-0.5 depending on well conditions.

In some embodiments, it is preferable to eccentrically position the gripper in the low side of the well bore such that only one linkage 12 needs to fit within the collapsed tool OD. When only one linkage 12 is present, the linkage 12 can generally be oversized and operate with larger safety factors to survive the rigors of down hole use. The structural rigidity of the ELG gripper 10 is preferably maintained due to the low number of moving parts and their relatively large size. The eccentric positioned gripper 10 within the well bore and the singular linkage 12 preferably removes the non-symmetrical loading of pinned multi-gripper centralized grippers. All expansion forces are preferably symmetric within the single linkage assembly.

Figure 7B:
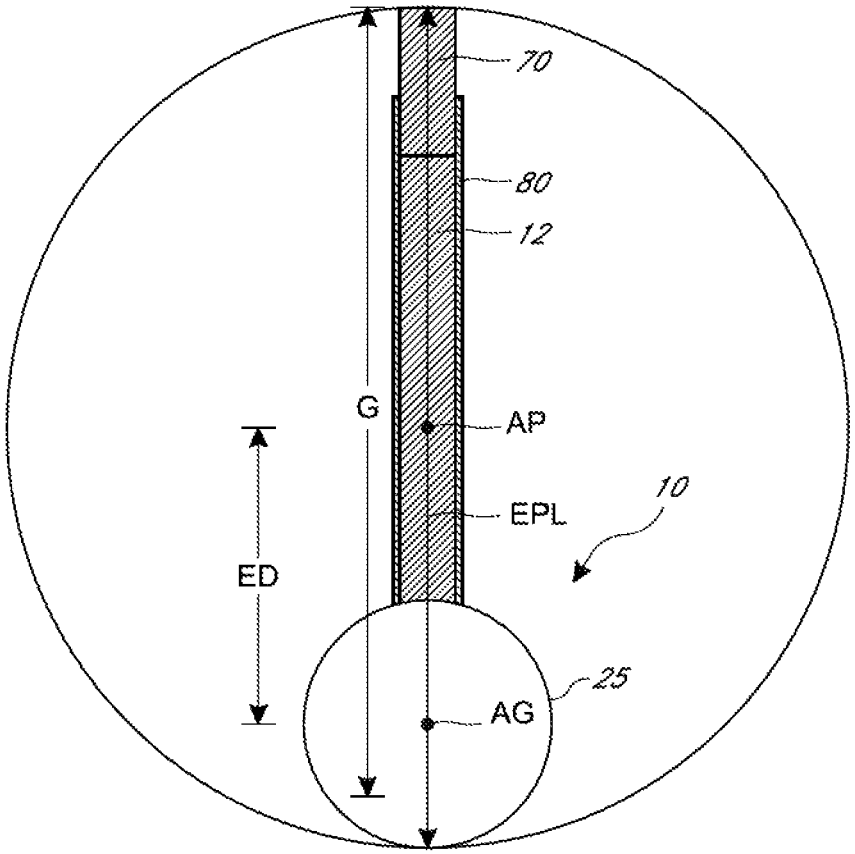
FIG. 7B is a head-on cross-section of the ELG in an expanded position within a wellbore.

FIGS. 7A and B illustrate a cross-section of the ELG gripper 10 in an expanded position within a wellbore. In FIG. 7A, the linkage 12 of the ELG gripper 10 extends from the elongate body 25 of the gripper 10 over 55% of the expanded throughfit outer OD of the gripper 10. FIG. 7A also illustrate the working operation expansion angle A defined as the angle between the load link 80 and the gripper body 25. A second cross-section of the ELG gripper 10 in an expanded position is shown in FIG. 7B. In this figure, the cross-section is taken facing "head-on" to the gripper 10. As shown, the linkage 12 extends from the elongate body 25 over 55% of the expanded throughfit outer OD of the gripper assembly. In some aspects, a ratio of the collapsed throughfit OD of the gripper 10 to a maximum radial length of the gripper 10 in an expanded configuration is more than 2, more than 2.5, more than 3, or more than 3.5.

In some embodiments, including the illustrated embodiment shown in FIG. 7A, the linkage 12 extends across more than 50% of an expanded throughfit outer OD of the gripper 10. In some aspects, the linkage 12 extends across more than 55% of the expanded throughfit outer OD of the gripper 10, more than 60% of the expanded throughfit outer OD of the gripper 10, more than 65% of the expanded throughfit outer OD of the gripper 10, more than 70% of the expanded throughfit outer OD of the gripper 10, or more than 75% of the expanded throughfit outer OD of the gripper 10. In some aspects, when the linkage 12 is in an expanded configuration, the linkage 12 extends across at least 70% of the expanded throughfit outer OD of the gripper 10.

As discussed above, in one general aspect, the geometry of the gripper 10 is such that body 25 is positioned eccentrically within the wellbore. In some embodiments, including the illustrated embodiment shown in FIGS. 7A and 7B, the passage has a diameter Dw and the linkage 12 in an expanded position extends a distance G from the longitudinal centerline axis of the gripper body 25 (seen as AG in the "head on" view of FIG. 7B). In some embodiments, an extended position length EPL is defined as the length from the end of the linkage 12 on a first side of the elongate body 25 to the opposite side of the elongate body 25, the EPL perpendicular to a longitudinal centerline axis AG of the gripper body 25. In some embodiments, including the illustrated embodiment, the gripper body 25 is eccentrically located within the passage such that the longitudinal centerline axis AG of the gripper body 25 is spaced apart an eccentric distance ED from a longitudinal centerline axis of the passage AP. In some embodiments, including the illustrated embodiment, a ratio of half of the extended position length EPL of the gripper 10 to half of the collapsed throughfit OD of the gripper 10 is desirably approximately 3.5 In some embodiments, including the illustrated embodiment, a ratio of half of the extended position length EPL of the gripper 10 to half of the collapsed throughfit OD of the gripper 10 is at least 1.5, at least 2, at least 2.5, at least 3, at least 3.5, at least 4, at least 4.5, and at least 5. In some embodiments, including the illustrated embodiment, the midpoint of the EPL (EPLmid) (which corresponds to the longitudinal centerline axis of the passage AP in FIG. 7B) is spaced a distance from the longitudinal centerline axis AG of the gripper body 25 by an eccentric distance EDmid (which in FIG. 7B corresponds to the eccentric distance ED) when the gripper is in the expanded position. In some embodiments, including the illustrated embodiment, a ratio of half of the extended position length EPL of the gripper 10 to the EDmid is desirably approximately 3.5. In some embodiments, including the illustrated embodiment, a ratio of half of the extended position length EPL of the gripper 10 to the EDmid is at least 1.5, at least 2, at least 2.5, at least 3, at least 3.5, at least 4, at least 4.5, and at least 5.

Figure 8B:
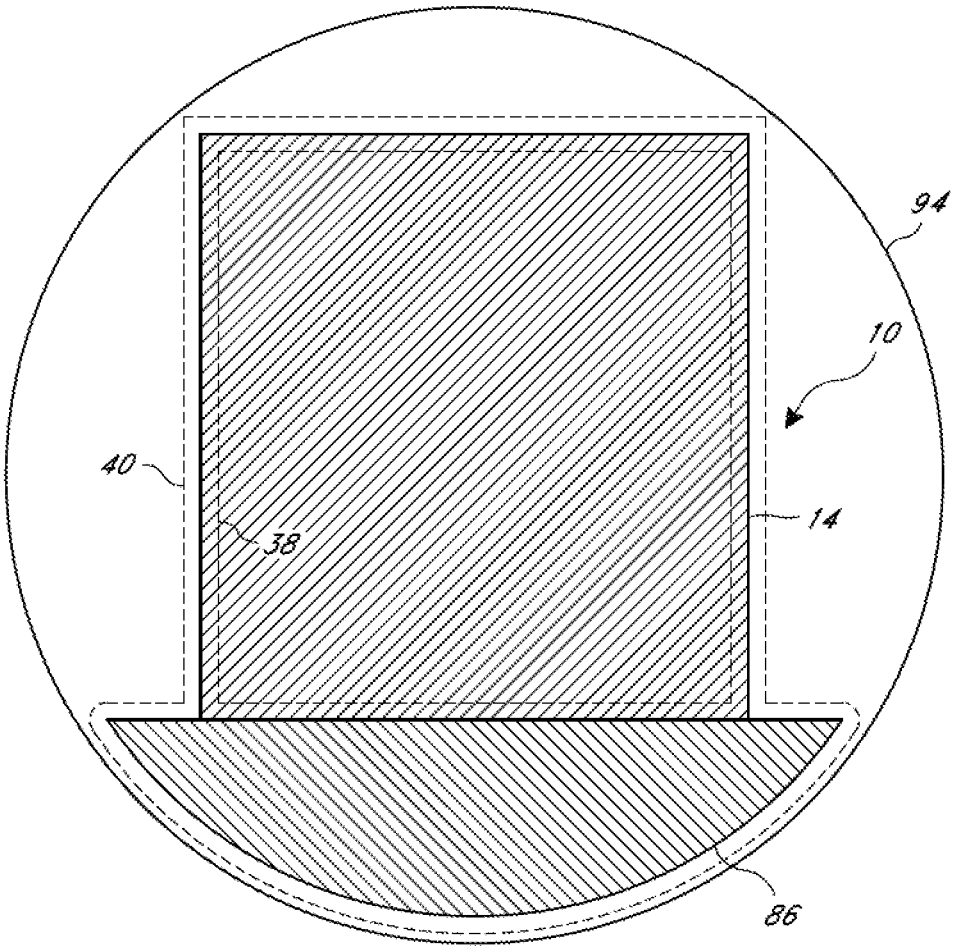
FIG. 8B is a head-on cross-section of the ELG in a collapsed position illustrating the throughfit OD of the gripper assembly.

FIGS. 8A and B illustrate a cross-section of the ELG gripper 10 in a collapsed position. In FIG. 8A, the cross-sectional area 38 of the linkage 12 is illustrated as compared to the total cross-sectional area 40 of the gripper 10. FIG. 8B illustrates a "head on" cross-sectional view of the gripper 10 as indicated in FIG. 8A. FIG. 8B further illustrates the comparison between the cross-sectional area 38 of the linkage 12 as compared to the total cross-sectional area 40 of the gripper 10. In this embodiment, the area of the linkage 12 is at least 35% of the cross-sectional area of the gripper 10 defined by a collapsed throughfit OD of the gripper 10. The collapsed throughfit OD of the gripper 10 is shown as a solid line around the collapsed gripper 10.

One advantage of the geometry of the gripper 10 as illustrated in FIGS. 8A and 8B is that the links can be larger and more robust such that the overall linkage 12 is more robust as compared to previous designs. As a result, the cross-sectional area of the linkage 12 can be a large percentage of the cross-section of the gripper 10. The gripper 10 illustrated in FIG. 8B in shown in a fully collapsed configuration such that the gripper 10 can fit through the smallest throughfit OD of a wellbore for the tractor. In some aspects, the cross-sectional area 38 of the linkage 12 is at least 35%, at least 40%, at least 45%, or at least 50% of the cross-sectional area 40 of the gripper 10 when the gripper 10 is in a fully collapsed configuration such as that shown in FIG. 8B. In some aspects, the cross-sectional area 38 of the linkage 12 is at least 20%, at least 25%, or at least 30% of the cross-sectional area 40 of the gripper 10 when the gripper 10 is in a fully collapsed configuration such as that shown in FIG. 8B.

In some aspects, a ratio of the expanded throughfit OD of the gripper in an expanded configuration to an collapsed throughfit OD of the gripper is more than 2, more than 2.5, more than 2.75, more than 3, or more than 3.25.

Although these inventions have been disclosed in the context of a certain preferred embodiment and examples, it will be understood by those skilled in the art that the present inventions extend beyond the specifically disclosed embodiments and embodiments disclosed to other alternative embodiments and/or uses of the invention and obvious modifications and equivalents thereof. Additionally, it is contemplated that various aspects and features of the inventions described can be practiced separately, combined together, or substituted for one another, and that a variety of combination and subcombinations of the features and aspects can be made and still fall within the scope of the invention. Thus, it is intended that the scope of the present invention herein disclosed should not be limited by the particular disclosed embodiments described above, but should be determined only by a fair reading of the claims.

What is claimed is:

1. A gripper, comprising:

a body; and a grip assembly coupled to the body, the grip assembly comprising a single linkage including a wall engagement portion configured to grip an interior surface defining a wellbore, said wall engagement portion extendable away from the body;

wherein when movement of the single linkage causes the wall engagement portion to exert force on the interior surface defining the wellbore, the resultant force translates the body along the wellbore;

wherein a cross-sectional area of the single linkage when the gripper is in a fully collapsed configuration is at least 35% of a cross-sectional area of the gripper, the cross-sectional area of the gripper defined by a collapsed, throughfit OD of the gripper.

2. The gripper of claim 1, said grip assembly further comprising a ramp positioned to interact with the linkage as the wall engagement portion extends away from the body.

3. The gripper of claim 1, further comprising an actuator for causing the wall engagement portion to exert outward force.

4. The gripper of claim 3, wherein the actuator is within the body.

5. The gripper of claim 1, wherein a ratio of an expanded throughfit OD of the gripper in an expanded configuration to a collapsed throughfit OD of the gripper is more than 2.

6. The gripper of claim 1, wherein the maximum radial expansion of the linkage desirably occurs when the angle between the elongate body and the linkage is between 50 and 75 degrees.

7. The gripper of claim 1, wherein the cross-sectional area of the linkage is at least 45% of the cross-sectional area of the gripper when the gripper is in a fully collapsed configuration.

8. A gripper assembly comprising:

a linkage comprising a wall engagement portion for engaging an interior of a wellbore, the linkage comprising:

a lower link connector rotatably connected to a first push link and a second push link, the lower link connector slidably attached to an elongate body at a first location;

a load link rotatably attached to the elongate body at a second location spaced from said first location;

an upper link connector rotatably connected to the first and second push links and the load link; and an expansion surface upon which the first and second push links act to provide an expansion force;

wherein for a first expansion range the movement of the first and second push links upon the expansion surface expands the linkage and for a second expansion range the movement of the first and second push links pushing against a first end of the upper link connector expands the linkage;

wherein the wall engagement portion comprises a surface of the load link and movement of the gripper along the interior surface of the wellbore results from the lower link connector sliding with respect to the elongate body; wherein the gripper assembly comprises a single linkage.

9. The gripper assembly of claim 8, wherein the expansion surface is a ramp positioned to interact with the linkage as the wall engagement portion extends away from the body.

10. The gripper assembly of claim 9, wherein the first push link, the second push link, the upper link connector, and the lower link connector form an approximately parallelogram shape when the link mechanism is expanded.

11. The gripper assembly of claim 9, wherein the ratio of a length of the first push link to a length of the second push link is approximately 1.

12. The gripper assembly of claim 9, wherein a maximum angle of the load link with respect to the elongate body does not exceed 80 degrees.

13. The gripper assembly of claim 8, wherein the upper link connector comprises a slot and the load link comprises a pin coupled within the slot.

* * * * *